United States Patent [19]

Kaneko et al.

[11] 4,344,614

[45] Aug. 17, 1982

[54] COLLATOR

[75] Inventors: Tamaki Kaneko, Fujisawa; Tugio Okuzawa, Tokyo, both of Japan

[73] Assignee: Ricoh Company, Ltd., Japan

[21] Appl. No.: 125,976

[22] Filed: Feb. 29, 1980

[30] Foreign Application Priority Data

Mar. 7, 1979 [JP] Japan ..... 54-27870

[51] Int. Cl.[3] ..... B65H 39/11; B65H 7/06

[52] U.S. Cl. ..... 271/288; 271/3.1; 271/118; 271/127; 271/259; 271/296

[58] Field of Search ..... 271/288, 289, 290, 296, 271/287, 259, 3.1, 291, 297, 127, 118; 355/35 H, 145 H, 14 R

[56] References Cited

U.S. PATENT DOCUMENTS

| | | | |
|---|---|---|---|
| 3,774,906 | 11/1973 | Fagan et al. | 271/289 |
| 3,977,672 | 8/1976 | Godlewski | 271/118 X |
| 4,025,066 | 5/1977 | Sue | 271/127 X |
| 4,166,614 | 9/1979 | Hamlin et al. | 271/3.1 |
| 4,200,386 | 4/1980 | Queener | 271/287 X |
| 4,273,326 | 6/1981 | Snellman et al. | 271/288 |

*Primary Examiner*—Bruce H. Stoner, Jr.
*Attorney, Agent, or Firm*—McGlew and Tuttle

[57] ABSTRACT

A collator comprising a plurality of bins to which sheets supplied from a copying apparatus, printing apparatus, or the like are successively delivered. The collator is provided with a jam tray for storing sheets which are supplied to the collator following the occurrence of a sheet jam, a pair of sheet feeding rollers being arranged on the jam tray for feeding one sheet after another from a stack of sheets on the jam tray to a sheet conveying passage in the collator.

5 Claims, 2 Drawing Figures

COLLATOR

BACKGROUND AND FIELD OF THE INVENTION

This invention relates in general to a collator used with a copying apparatus, printing apparatus, or the like and, more particularly, to a collator having means for directing, storing and returning sheet in relation to a sheet conveying path.

One type of collator known in the art comprises a plurality of bins arranged side by side in spaced parallel relation, conveyor means for conveying sheets on which symbols have been formed from a copying apparatus or printing apparatus to the bins, and direction changing means for changing the direction of movement of the printed sheets to successively deliver them to the bins from the conveyor means. The collator may be provided with sheet jam detecting means for detecting a jam of printed sheets supplied to the collator. When the detecting means has detected the occurrence of a sheet jam, the printed sheets can be ejected onto a tray of the main body of the copying apparatus or the printing apparatus without being forwarded to the collator. The printed sheets ejected onto the tray are either manually delivered to the bins or automatically fed to the bins by the individual operation of the collator after the sheet jam has been removed. Handling of the printed sheets performed as described hereinabove after the sheet jam has been removed, however, is troublesome and may lead to a situation in which collating or sorting of the printed sheets is not effected positively.

SUMMARY OF THE INVENTION

This invention has as its object the provision of a collator which obviates the aforesaid disadvantage of the prior art.

The aforesaid object of the invention can be accomplished by providing a collator of the aforesaid type of the prior art with a jam tray for temporarily storing thereon printed sheets which are supplied to the collator following the occurrence of a sheet jam, and sheet feeding means for feeding one printed sheet after another from the jam tray to a sheet conveying passage in the collator.

In the preferred embodiment of the invention, the jam tray is equipped with arraying means for placing in order in a predetermined position a stack of printed sheets piled thereon, so that the stack of printed sheets can be readily fed in the next following sheet feeding operation.

It is a further object of the invention to provide an improved collator suitable for collating sheets received from a copying apparatus, printing apparatus or the like of the type having, in combination, a plurality of bins arranged side by side in spaced parallel relation, conveying means for conveying these sheets through a sheet conveying path to the plurality of bins, direction changing means for changing the direction of the movement of the sheets conveyed by the conveying means for selectively delivering these sheets to the plurality of bins, and sheet jam detecting means for detecting a sheet jam occurring in the sheet conveying path. In accordance with the invention, there is provided a jam tray disposed adjacent to the sheet conveying path for temporarily storing thereon the sheets following the occurrence of a sheet jam and sheet feeding means for feeding one sheet after another from a stack of sheets on the jam tray to the sheet conveying path.

It is a further object of the invention to provide a collator which is simple in design, rugged in construction and economical to manufacture.

For an understanding of the principles of the invention, reference is made to the following description of typical embodiments thereof as illustrated in the accompanying drawings.

BRIEF DESCRIPTION OF THE DRAWINGS

In the Drawings.

The preferred embodiment of the invention will be described by referring to the accompanying drawings, in which.

DETAILED DESCRIPTION OF THE DRAWINGS

Figure 1:
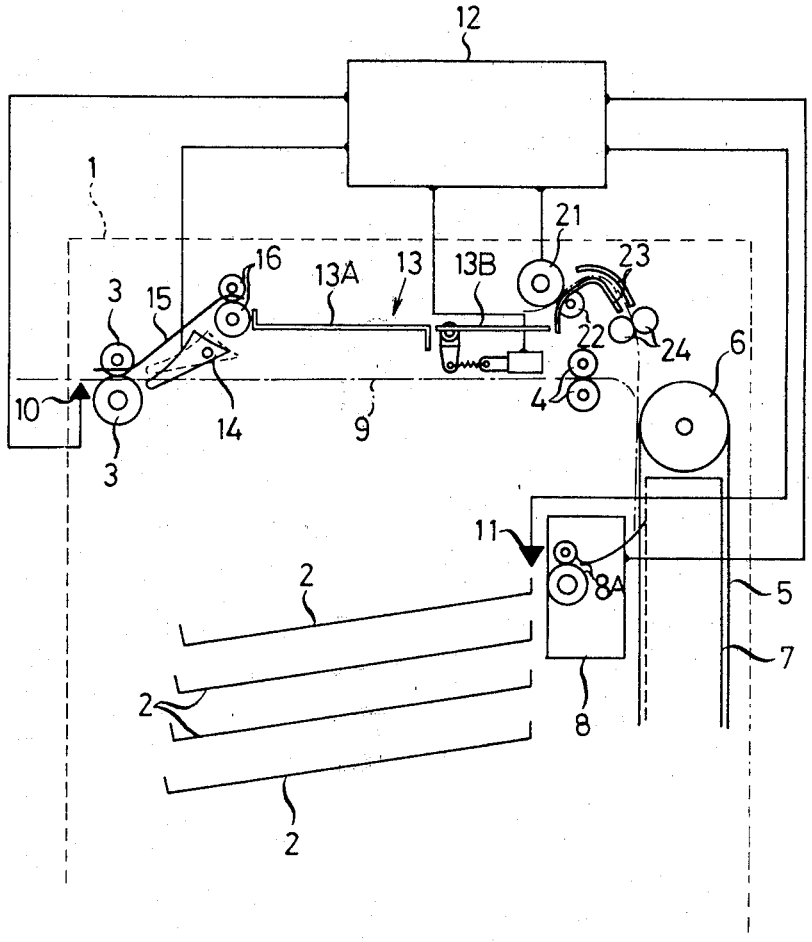
FIG. 1 is a schematic view of the collator according to the invention.

Referring to FIG. 1, a collator 1 comprises a plurality of bins 2 arranged side by side in spaced parallel relation. Printed sheets from a copying apparatus, for example, are supplied via a pair of sheet receiving rollers 3 and a pair of feeding rollers 4 to a conveyor belt 5 along a sheet conveying path 9. The conveyor belt 5 is trained over a drive roller 6 and a follower roller (not shown), and a suction box 7 is located between parallel runs of the conveyor belt 5 to draw a printed sheet by suction and cause the printed sheet to adhere to the conveyor belt 5 as the printed sheet is conveyed vertically downwardly by the belt 5, so that such printed sheet can be positively conveyed downwardly by the conveyor belt 5. A direction changing means 8, operative to move step by step for a distance equal to the spacing interval between the adjacent bins 2, is provided for changing the direction of movements of the printed sheets conveyed by the conveyor belt 5 and delivering each of them to one of the bins 2. A detecting switch 10 is located in the sheet conveying path 9 in the vicinity of the pair of the sheet receiving rollers 3, and another detecting switch 11 is located on the discharge side of a pair of discharge rollers 8A of the direction changing means 8. The detecting switches 10, 11, as shown in FIG. 1, are operatively connected to a control means 12. If the second detecting switch 11 detects the passing of a printed sheet when a predetermined time has elapsed following the detection of the supply of the printed sheet by the first detecting switch 10, then no sheet jam is understood to occur and the collator normally functions. However, if the printed sheet is not detected by the second detecting switch 11 when the predetermined time has elapsed, a sheet jam has occurred and a jam sensing signal is generated by control means 12.

A jam tray 13 is located above the sheet conveying path 9, and a deflecting plate 14 is disposed downstream of the pair of sheet receiving rollers 3 to direct the printed sheets which are supplied from the copying apparatus away from the sheet conveying path 9 and to the jam tray 13 after occurrence of a sheet jam. A guide plate 15, and a pair of discharge rollers 16 located downstream of the deflecting plate 14 pass printed sheets onto the jam tray 13.

Figure 2:
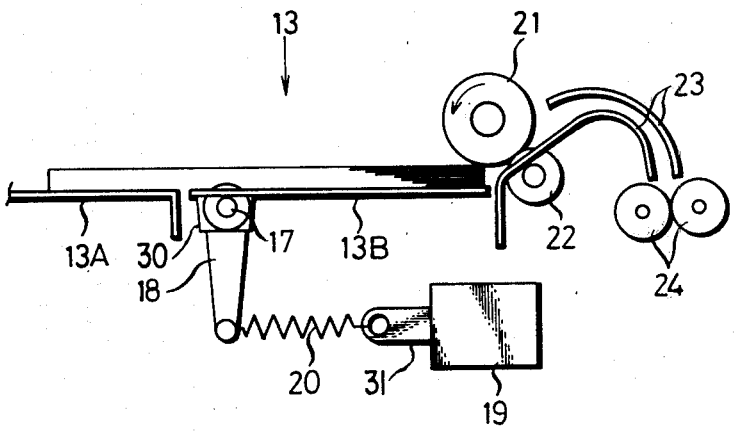
FIG. 2 is a schematic view of the essential portions of the collator according to the invention.

Referring to FIG. 2, the jam tray 13 includes a fixed portion 13A and a sheet pressing portion 13B supported by a shaft 17 which in turn is pivotally supported by two side plates 30, only one of which is shown, so that the sheet pressing portion 13B can be pivotably moved. The shaft 17 has secured thereto a lever 18 which is connected via a spring 20 to a plunger 31 of a sheet pressing portion drive solenoid 19. A sheet feed roller 21 and a separating roller 22 deposed to form a pair of rollers are located on an end of the jam tray 13 opposite to the end thereof at which the pair of discharge rollers 16 is located. Guide plates 23, and a pair of feed rollers 24 are provided downstream of the jam tray 13 for returning the sheets to the sheet conveying path 9. The jam tray 13 is further equipped with a sheet arraying plate (not shown) for arranging in order the printed sheets ejected and stacked on the tray 13. The sheet arraying plate is operative to bring the sides and ends of the sheets into alignment so that the sheets will be ready for the next sheet feeding operation. The arraying means may be of any known type.

During normal operation of the collator 1, the defecting plate 14 is in a broken line position shown in FIG. 1 to allow printed sheets to be forwarded by the pair of sheet receiving rollers 3 along the sheet conveying path 9 and supplied to the conveyor belt 5 by the pair of feed rollers 4. The printed sheets are then conveyed vertically downward by the conveyor belt 5 cooperating with the suction box 7 as described hereinabove, so that the sheets can be successively delivered by the direction changing means 8 to the bins 2.

When the occurrence of a sheet jam is detected by the detecting switches 10 and 11, a signal is generated by the control means 12 to move the deflecting plate 14 from the broken line position to a solid line position so that the printed sheets supplied to the collator 1 can be deflected from the sheet conveying path 9 via the deflecting plate 14, guide plate 15 and pair of discharge rollers 16 and the jam tray 13, to pile in a stack thereon. The stack of printed sheets on the jam tray 13 is arranged in an orderly manner as the sides and ends of the sheets are brought into alignment by the sheet arraying plate (not shown) as described hereinabove.

When the sheet jam occurring on the sheet conveying passage 9 is removed and the collator 1 is restored to normalcy, the control means 12 generates a sheet feed starting signal which moves the sheet feed roller 21 counter clockwise in FIG. 2 and energizes the sheet pressing portion drive solenoid 19. The lever 18 is pulled via the spring 20, so that the sheet pressing portion 13B moves upwardly the stack of printed sheets thereon to bring the uppermost sheet into contact with the sheet feed roller 21. Thus the uppermost sheet is fed by the rotating sheet feed roller 21 and moved through the guide plates 23 and pair of feed rollers 24 to the sheet feeding path 9 in a portion thereof anterior to the conveyor belt 5. Thus the printed sheets are successively fed from the jam tray 13 and delivered to the bins 2 as described hereinabove. The separating roller 22 rotates slowly in a direction opposite to the direction of movement of the printed sheets to avoid simultaneous feeding of more than one sheet. Instead of rotating as aforesaid, the separating roller 22 may remain stationary.

From the foregoing description, it will be appreciated that in the collator according to the invention, it is possible to cope with a sheet jam without immediately shutting down the copying apparatus or printing apparatus when the sheet jam occurs, and that collating or sorting of the printed sheets can be carried out positively and accurately in a short period of time after the sheet jam is removed.

While a specific embodiment of the invention has been shown and described in detail to illustrate the application of the principles of the invention, it will be understood that the invention may be embodied otherwise without departing from such principles.

What is claimed is:

1. An improved collator suitable for collating sheets received from a copying apparatus, printing apparatus or the like of the type having, in combination, a plurality of bins arranged side by side in spaced parallel relation;

conveying means for conveying the sheets through a sheet conveying path to the plurality of bins;

direction changing means for changing the direction of movement of the sheets conveyed by the conveyor means for selectively delivering the sheets to the plurality of bins;

sheet jam detecting means for detecting a sheet jam occurring in the sheet conveying path; a jam tray disposed adjacent to the sheet conveying path for temporarily storing thereon the sheets following the occurrence of a sheet jam; a deflecting plate for deflecting sheets from the sheet conveying path to the jam tray; and control means operable responsive to said jam detecting means for moving the deflecting plate to a position for directing the sheets from the sheet conveying path to the jam tray; wherein the improvement comprises;

the jam tray including a fixed portion and a sheet pressing portion movably mounted adjacent said fixed portion;

sheet feeding means for feeding one sheet after another from a stack of sheets on said sheet pressing portion of the jam tray to the sheet conveying path; and said sheet feeding means including sheet feed roller means for engaging a sheet on said sheet pressing portion and directing the sheet therefrom to the sheet conveying path, and means, operably connected to the control means, for moving said sheet pressing portion to engage a sheet on said sheet pressing portion with said sheet feed roller means responsive to said control means.

2. A collator as claimed in claim 1, wherein said means for moving said sheet pressing portion includes a solenoid operatively connected to the control means, said solenoid having a plunger movable responsive to a signal received from the control means, and said plunger being operatively connected to said sheet pressing portion so that said sheet pressing portion is movable responsive to the movement of said plunger.

3. A collator as claimed in claim 2, wherein said sheet feeding means includes guide means for receiving a sheet from said sheet feed roller means and guidingly directing the sheet to the sheet conveying path.

4. A collator as claimed in claim 3, wherein the jam tray is mounted above and in spaced relation to the sheet conveying path.

5. A collator as set forth in claim 2, wherein said sheet feed roller means comprises a first roller and a second roller mounted in spaced relation to said first roller to define a path therebetween for the passage of a sheet from said sheet pressing portion to the sheet conveying path, said first roller being operatively connected to the control means for rotation responsive to a signal received from the control means.

* * * * *